US011533995B2

(12) United States Patent
Schöpfer et al.

(10) Patent No.: US 11,533,995 B2
(45) Date of Patent: Dec. 27, 2022

(54) CABINET PULL-OUT FOR A CABINET ELEMENT

(71) Applicant: Peka-Metall AG, Mosen (CH)

(72) Inventors: Roland Schöpfer, Ebnet (CH); Urs Eichenberger, Beinwil am See (CH); Bernhard Weber, Beinwil am See (CH)

(73) Assignee: Peka-Metall AG, Mosen (CH)

( * ) Notice: Subject to any disclaimer, the term of this patent is extended or adjusted under 35 U.S.C. 154(b) by 160 days.

(21) Appl. No.: 17/141,215

(22) Filed: Jan. 4, 2021

(65) Prior Publication Data

US 2021/0219721 A1 Jul. 22, 2021

(30) Foreign Application Priority Data

Jan. 17, 2020 (EP) ..... 20152561

(51) Int. Cl.
*A47B 88/75* (2017.01)
*A47B 88/423* (2017.01)
(Continued)

(52) U.S. Cl.
CPC ..... *A47B 88/75* (2017.01); *A47B 77/14* (2013.01); *A47B 88/42* (2017.01); *A47B 88/423* (2017.01);
(Continued)

(58) Field of Classification Search
CPC ..... A47B 88/42; A47B 88/0485; A47B 88/75; A47B 88/407; A47B 88/0407;
(Continued)

(56) References Cited

U.S. PATENT DOCUMENTS 3,675,781 A * 7/1972 Chamberlin ..... A47B 65/15 211/11
4,782,960 A * 11/1988 Mavrakis ..... A47B 57/585 211/184
(Continued)

FOREIGN PATENT DOCUMENTS

DE 202016000219 U1 * 2/2016 ..... A47B 88/70
DE 202019103363 U1 12/2019
(Continued)

OTHER PUBLICATIONS

European Search Report from Application No. EP20152561 dated Apr. 17, 2020, 4 pages.

*Primary Examiner* — Andrew M Roersma
(74) *Attorney, Agent, or Firm* — Hard IP LLC

(57) ABSTRACT

A cabinet pull-out comprises a first storage compartment and a second storage compartment and a pull-out frame, the pull-out frame connecting the first storage compartment to the second storage compartment. The first and the second storage compartment each are provided with a base. The pull-out frame comprises a carrier element which extends essentially rectangularly to the base area of the corresponding storage compartment. Each of the first and second storage compartments are provided with a front wall and a rear wall and two side walls each extending between the front wall and the rear wall. The carrier element is attached to an external side of the rear wall or one of the side walls. A loose storage compartment can be detachably coupled to one of the first or second storage compartments.

13 Claims, 8 Drawing Sheets

(51) Int. Cl.

| | |
|---|---|
| ***A47B 77/14*** | (2006.01) |
| ***A47B 88/42*** | (2017.01) |
| ***A47B 88/994*** | (2017.01) |
| ***A47B 88/90*** | (2017.01) |

(52) U.S. Cl.
CPC ..... *A47B 88/994* (2017.01); *A47B 88/9418* (2017.01); *A47B 2088/76* (2017.01)

(58) Field of Classification Search
CPC ... A47B 88/994; A47B 88/969; A47B 88/913; A47B 88/9412; A47B 88/0018; A47B 88/9418; A47B 88/0029; A47B 88/70; A47B 88/02; A47B 88/90; A47B 2088/422; A47B 2088/0492; A47B 2088/76; A47B 2088/026; A47B 2088/023; A47B 2088/004; A47B 77/14; A47B 77/18; A47B 95/00; A47B 2210/09
See application file for complete search history.

(56) References Cited

U.S. PATENT DOCUMENTS

| | | | | |
|---|---|---|---|---|
| 2014/0197121 | A1* | 7/2014 | Knight | A47B 88/988 211/86.01 |
| 2015/0366377 | A1 | 12/2015 | Savage et al. | |
| 2016/0345731 | A1* | 12/2016 | Youngs | A47B 88/42 |

FOREIGN PATENT DOCUMENTS

| | | | | | |
|---|---|---|---|---|---|
| EP | 1661491 | A1 | | 5/2006 | |
| EP | 2526823 | A1 | | 5/2011 | |
| EP | 2526827 | A1 | * | 11/2012 | A47B 88/906 |
| EP | 3087867 | A1 | * | 11/2016 | A47B 88/919 |
| EP | 3087867 | A1 | | 11/2016 | |
| GB | 662108 | A | * | 11/1951 | A47B 88/931 |
| KR | 20130051593 | A | | 5/2013 | |
| WO | WO-0078187 | A2 | * | 12/2000 | A47B 88/994 |
| WO | WO-2018007286 | A1 | * | 1/2018 | A47B 96/021 |

* cited by examiner

CABINET PULL-OUT FOR A CABINET ELEMENT

CROSS-REFERENCE TO RELATED APPLICATIONS

This application claims the benefit of European patent application no. EP 20152561.5, filed Jan. 17, 2020, the contents of which is incorporated herein by reference in its entirety.

TECHNICAL FIELD

The present invention relates to a cabinet pull-out for a cabinet element.

DESCRIPTION OF RELATED ART

A cabinet element with a cupboard pull-out is known from the document EP2526823 B1. The cabinet element has a cabinet base, two side walls and a cover. The cabinet pull-out is formed from a pull-out frame which has a front support profile and a rear support profile, which are connected to one another by an upper cross profile and a lower cross profile. There is a linear guide on each of the transverse profiles to move the cabinet pull-out relative to the fixed cabinet element. Storage compartments are attached to the pull-out frame that protrude beyond the pull-out frame on both sides.

The storage compartments are suitable for storing light objects. If storage compartments are used for heavy objects, such as beverage bottles, a deformation of the storage compartments may result. For example, the floor area can no longer be aligned exactly horizontally, it becomes tilted when loaded. The storage compartments, in particular their side walls, can also be inclined under load. If the distance between the storage compartment and the closest side wall of the cabinet element is subject to a narrow tolerance, the storage compartment can therefore come into contact with the nearest side wall, so that the pull-out cabinet can jam when it is opened or closed.

There is therefore a need for a cabinet pull-out that has increased rigidity. In particular, the cabinet pull-out should have increased torsional rigidity.

BRIEF SUMMARY OF THE INVENTION

It is an object of the invention to develop a cabinet pull-out which has storage compartments that remain dimensionally stable, even when the storage compartments are loaded with heavy objects. In addition, it should be possible to arrange the shelf individually and/or to individually design or adapt the room layout without impairing the dimensional stability.

If the term "for example" is used in the following description, this term relates to exemplary embodiments and/or variants, which is not necessarily to be understood as a more preferred application of the teaching of the invention. The terms "preferably", "preferred" are to be understood in a similar manner by referring to an example from a set of exemplary embodiments and/or variants, which is not necessarily to be understood as a preferred application of the teaching of the invention. Accordingly, the terms "for example", "preferably" or "preferred" can relate to a plurality of exemplary embodiments and/or embodiments.

The following detailed description contains various exemplary embodiments for the cabinet pull-out according to the invention. The description of a particular cabinet pull-out should only be viewed as an example. In the description and claims, the terms "contain", "comprise", "have" are interpreted as "including, but not limited to".

In the following, the term rigidity of the cabinet pull-out means that the cabinet pull-out, in particular the storage compartment, is resistant to deformation by a load which acts on the cabinet pull-out, in particular the storage compartment.

A cabinet pull-out comprises at least a first storage compartment and a second storage compartment and a pull-out frame. The pull-out frame connects the first storage compartment with the second storage compartment. The first and second storage compartments each are provided with a first and a second base. The pull-out frame comprises a carrier element which is arranged substantially rectangularly to the base of the corresponding storage compartment and extends from the first to the second storage compartment. Each of the first and second storage compartments is provided with a front wall and a rear wall. Each of the first and second storage compartments each is provided with two side walls extending between the front wall and the rear wall. The carrier element is attached to an external side of the rear wall or one of the side walls. The carrier element can also be configured as an angle element which is attached to the rear wall and one of the adjacent side walls.

A loose storage compartment can be detachably coupled to one of the first or second storage compartments. Of course, several loose storage compartments can be arranged one below the other or next to one another. The maximum number of loose storage compartments to be arranged next to each other is limited by the width of the first or second storage compartment and depends on the corresponding width of the loose storage compartment, which can differ from the width of the first or second storage compartment. The maximum number of loose storage compartments to be arranged one behind the other is limited by the length of the first or second storage compartment and depends on the corresponding length of the loose storage compartment, which can differ from the length of the first or second storage compartment.

According to an embodiment, the loose storage compartment is provided with a base and a front wall, a rear wall and two side walls extending from the front wall and the rear wall, which laterally delimit the base and protrude beyond the base on its upper side. The front wall and the rear wall can each be provided with a connecting element which extends below the base so that it protrudes beyond the bottom of the base. The connecting element and the associated front wall or rear wall can be manufactured in a single piece. The connecting element in the assembled state can be arranged in a distance with respect to the base of the loose storage compartment and the base of the corresponding first or second storage compartment which is in the range of 5 cm up to and including 30 cm.

According to an embodiment, the connecting element in the assembled state is arranged adjacently to the inside of the corresponding front wall and the rear wall. Each of the connecting elements can be provided with at least one tab projecting beyond the outer surface of the connecting element which tab is configured to rest on the edge of the front wall or the rear wall.

According to an embodiment, the connecting element can be provided with a clamping element which projects at least partially beyond the outer surface of the connecting element, so that the clamping element is pressed onto the front wall or rear wall in the assembled state. In particular, the clamping element can contain a hook-shaped end which at least partially engages around the underside of the front wall or the rear wall in the assembled state.

According to an embodiment, the first storage compartment is provided with a first linear guide and the second storage compartment is provided with a second linear guide for the relative movement of the cabinet pull-out relative to a cabinet element. According to an embodiment, each of the storage compartments is provided with a maximum of one associated linear guide. In particular, the linear guide of the first storage compartment can be arranged adjacently to the first side edge. The linear guide of the second storage compartment can be arranged adjacently to the second side edge.

According to an embodiment, the first linear guide is arranged above the second linear guide. This means that the first linear guide is located on the bottom of the base of the first storage compartment. The second linear guide is located on the bottom of the base of the second storage compartment. According to the present exemplary embodiment, the two linear guides are located on the same side edge of the first and second storage compartment. This exemplary embodiment is used in particular in combination with a first and a second carrier element. The first carrier element is connected to the front walls of the first and second storage compartments. The second carrier element is connected in particular to the rear walls of the first and second storage compartments. The use of two carrier elements enables the manufacturing of a particularly torsion-resistant cabinet pull-out.

According to an embodiment, the first and second storage compartments are connected to one another via a single carrier element. In order to save material and weight, one of the two carrier elements can be dispensed with. In particular, the carrier element, which connects the two front walls of the first and second storage compartment to one another, can be dispensed with. In many cases, a cover is provided which forms the front of the cabinet pull-out in order to meet aesthetic requirements and to cover the front of the cabinet space. This cover can be connected to the first and second storage compartments by means of a fastening means located on the front wall, for example a mounting plate element. As the cover fixes the position of the first storage compartment relative to the second storage compartment, the necessary dimensional stability of the cabinet pull-out can be achieved with this cover in the assembled state, so that the associated carrier element can be dispensed with.

According to an embodiment, the base is of a rectangular shape. The base can be formed by a base plate. The base plate can contain wood, metal, or a plastic. In particular, the base plate can consist of one of the materials from the group of woods, plastics, or metals. In particular, the base is provided with a longitudinal direction and a transverse direction, the longitudinal direction corresponding to the extension direction. According to this exemplary embodiment, the base is provided with a front edge, a rear edge and a first side edge connecting the front edge and the rear edge and a second side edge connecting the front edge and the rear edge. The base has a bottom and a top. The top can be used as a shelf for items to be stored in a closet. The distance between the top and the bottom corresponds to the thickness of the base plate. The thickness can range from 1 mm up to and including 10 mm. In particular, the thickness can be 1 up to and including 3 mm.

The base of the storage compartment can include a groove. A surprisingly high degree of rigidity of the cabinet pull-out can be obtained by the combination of the fastening of the carrier element and the groove in the base. According to an embodiment, the groove projects beyond the bottom of the base. According to an embodiment, the groove extends in the longitudinal direction. In particular, the base has a longitudinal central axis which extends in the longitudinal direction. According to an embodiment, the groove is arranged symmetrically with respect to the longitudinal central axis.

A surprisingly high dimensional stability of the storage compartment can be obtained by a groove extending in the longitudinal direction. In particular, there is increased dimensional stability against bends of the base in the plane of the longitudinal central axis. Such bends can be caused by a load of an object stored in the storage compartment. These bends can lead to a change in the shape of the longitudinal central axis, for example they can lead to a curvature of an essentially straight longitudinal central axis, which can result in the base no longer being arranged exactly horizontally. A carrier element extending in the direction of the longitudinal central axis can be dispensed with if a groove is provided according to one of the exemplary embodiments of the invention. This reduces the number of components required to produce the cabinet pull-out. In addition, the weight of the cabinet pull-out can be reduced because horizontal support elements are no longer required to stiffen the base of the storage compartment.

A left-hand storage compartment extends from the groove to the first side edge. A right-hand storage compartment extends from the groove to the second side edge. If the groove extends along the longitudinal central axis, the left-hand and right-hand storage compartments have essentially the same surface area. An insert element can be placed on the storage compartment so that both the left-hand and the right-hand storage compartments are available for storing objects. The insert element can be configured as an insert mat or insert plate. The insert element can contain a material which can prevent the objects from slipping during the pull-out movement or the insertion movement of the cabinet pull-out, for example a rubber material. For this purpose, the insert element can alternatively or additionally be provided with a structured surface of a material increasing the coefficient of static friction or a surface with increased surface roughness.

According to an embodiment, the groove can be V-shaped. According to an embodiment, the groove can be U-shaped. According to an embodiment, the groove extends from the front edge to the rear edge of the base. A surprisingly high dimensional stability of the storage compartment can be achieved by means of a V-shaped or U-shaped groove. The rigidity of the entire cabinet pull-out can be increased in such a way that additional reinforcing elements, such as horizontally arranged support elements, can be dispensed with.

According to an embodiment, a partition can be inserted into the groove. The partition can divide the base into two partial areas. Each of the partial areas can be used to store objects. If necessary, the partition can contain further partition elements which run parallel to the front edge or the rear edge of the base.

According to an embodiment, the base is provided with a rear edge, a front edge and a first side edge connecting the front edge and the rear edge and a second side edge connecting the front edge and the rear edge. The groove can extend from the front edge to the rear edge. Between the front edge and the rear edge, a recess can be formed in the region of the groove, into which the hook-shaped end of a clamping element of a connecting element of a loose storage compartment can be inserted.

According to an embodiment, the storage compartment comprises a side wall, wherein the side wall protrudes at least partially beyond the base. In particular, the side wall extends upward from the side edge. For example, the side wall can be obtained by bending over a plate element forming the base. Such a plate element can in particular be configured as a sheet metal element. According to an embodiment, the storage compartment is provided with a front wall extending between the side walls. In particular, the front wall can be detachably connected to the base.

According to an embodiment, the first and second storage compartments are provided with a first and second rear wall, wherein the carrier element is attached to the outside of the first and second rear wall. In particular, the carrier element can be detachably connected to each of the first and second rear walls, for example by means of a screw connection. The carrier element can extend directly adjacent to a corner of the first or second rear wall, it can also be arranged in the vicinity of one of the corners of the first or second rear wall. In particular, the carrier element is not arranged in the middle of the first or second rear wall. This arrangement of the carrier element, which is asymmetrical with respect to the first or second rear wall, has the advantage that the first and second rear walls themselves can be configured as a base element for a loose storage compartment. The loose storage compartment is provided with a front wall and a rear wall, wherein the connecting element is arranged or adjoins at the lower end of front and rear walls.

According to an embodiment, the connecting element at least partially surrounds the upper edge of the first or second rear wall or the first or second front wall so that the loose storage compartment can be placed on this edge, for example by means of a gripping connection or a plug connection, which can also be designed as a clamping element. The loose storage compartment can therefore only be attached when necessary and can be removed without tools when it is no longer needed. According to an embodiment, various loose storage compartments can be attached at different heights relative to the first or second storage compartment. According to an embodiment, the loose storage compartment can be attached to different locations on the first or second rear wall or the first or second front wall, it can be displaceable in relation to the rear walls or front walls.

According to one embodiment, the loose storage compartment can extend between the front wall and the rear wall. According to this exemplary embodiment, the loose storage compartment has essentially the same length as the associated first or second storage compartment. According to an embodiment, the loose storage compartment can have a shorter length than the storage compartment.

According to each of the embodiments, the carrier element can be configured as a hollow profile. According to each of the preceding embodiments, the pull-out frame is not provided with a transverse support element which extends parallel to the base of the storage compartment on its bottom along the longitudinal central axis of the base.

A linear guide enables the drawer to be displaced relative to a stationary cabinet element. The linear guide can be attached to the bottom of the base of the storage compartment. In particular, the carrier element and the linear guide cannot be connected. According to an embodiment, a first and a second linear guide are arranged on opposite side edges, in particular if the first and second storage compartments are connected to one another via a single carrier element.

An advantage of the cabinet pull-out according to the invention is its increased rigidity, which leads to increased dimensional stability of the storage compartment or the storage compartments, so that it is ensured that the storage surfaces remain essentially horizontal, even when relatively heavy objects are placed on the storage surfaces, for example containers filled with liquids such as beverage bottles or the like.

Another advantage of the cabinet pull-out according to the invention is that the cabinet pull-out is composed of fewer components than a previously known cabinet pull-out, for example a cabinet pull-out according to EP2526823 B1.

The invention also includes a loose storage compartment for a cabinet pull-out, for example according to any one of the preceding exemplary embodiments. The loose storage compartment is provided with a base and a front wall, a rear wall and two side walls extending from the front wall and the rear wall, which laterally delimit the base and protrude beyond the base. The front wall and the rear wall each are provided with a connecting element which extends below the base so that it protrudes beyond the bottom of the base.

In particular, the connecting element can be provided with a clamping element which protrudes over the outer surface of the connecting element at least in sections. For example, the clamping element is arranged at an angle with respect to the connecting element of a maximum of 10 degrees.

The invention also relates to a cabinet element comprising a cabinet pull-out according to any one of the preceding embodiments.

BRIEF DESCRIPTION OF THE DRAWINGS

The cabinet pull-out according to the invention is shown below in accordance with some exemplary embodiments. It is shown in FIG. 1 a schematic structure of a cabinet pull-out according to a first embodiment, FIG. 2 a loose storage compartment for a cabinet pull-out, FIG. 3 a detail of the loose storage compartment shown in FIG. 2, FIG. 4 a schematic structure of a cabinet pull-out according to a second embodiment, FIG. 5 an example of a cabinet element comprising a cabinet pull-out, FIG. 6 a section through cabinet element comprising a cabinet pull-out, FIG. 7 a third embodiment for a cabinet pull-out, FIG. 8 a rear view of the cabinet pull-out of FIG. 7, FIG. 9 a fourth embodiment for a cabinet pull-out, FIG. 10 a rear view of the cabinet pull-out of FIG. 9.

DETAILED DESCRIPTION

Figure 1:
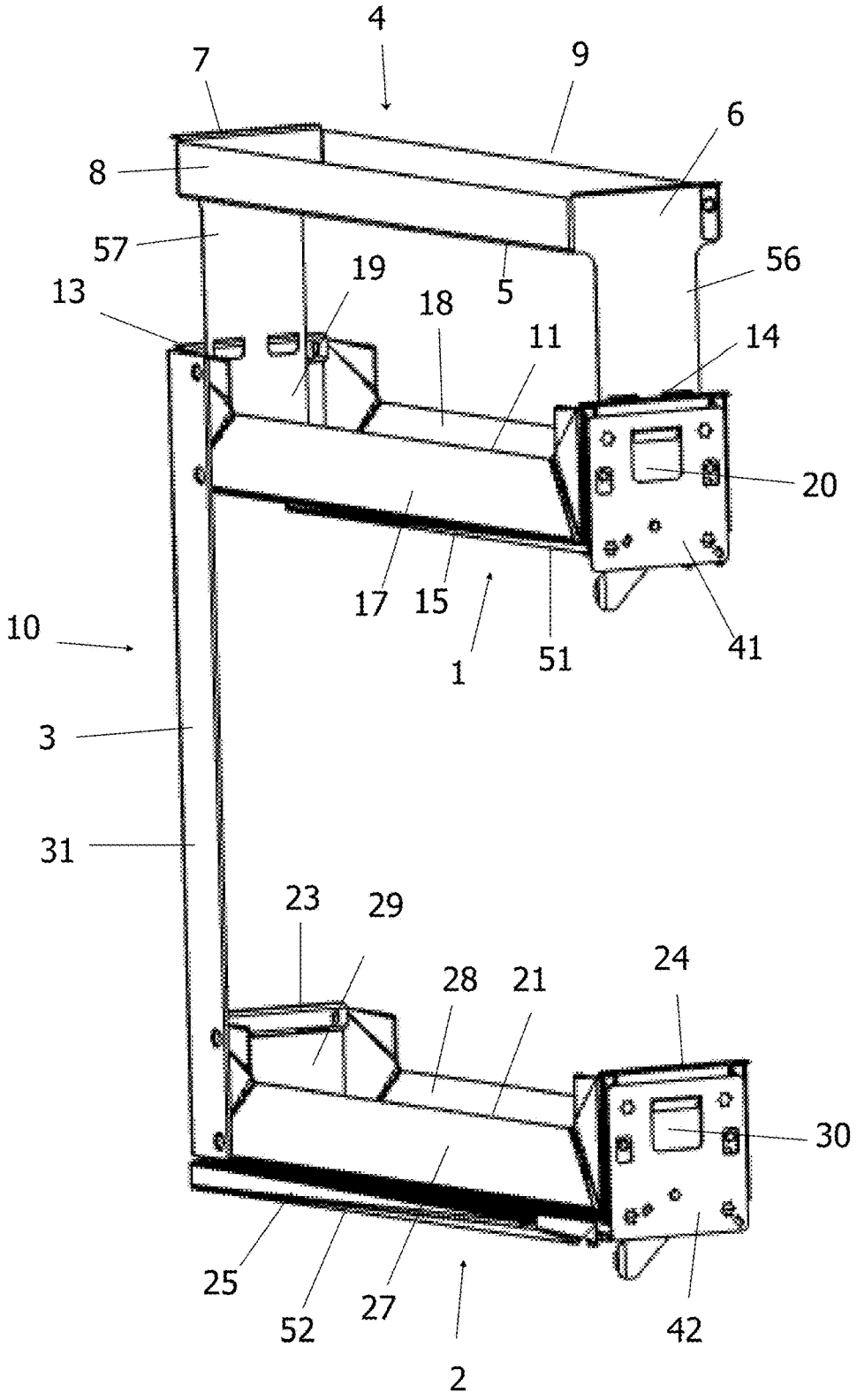
Figure 7:
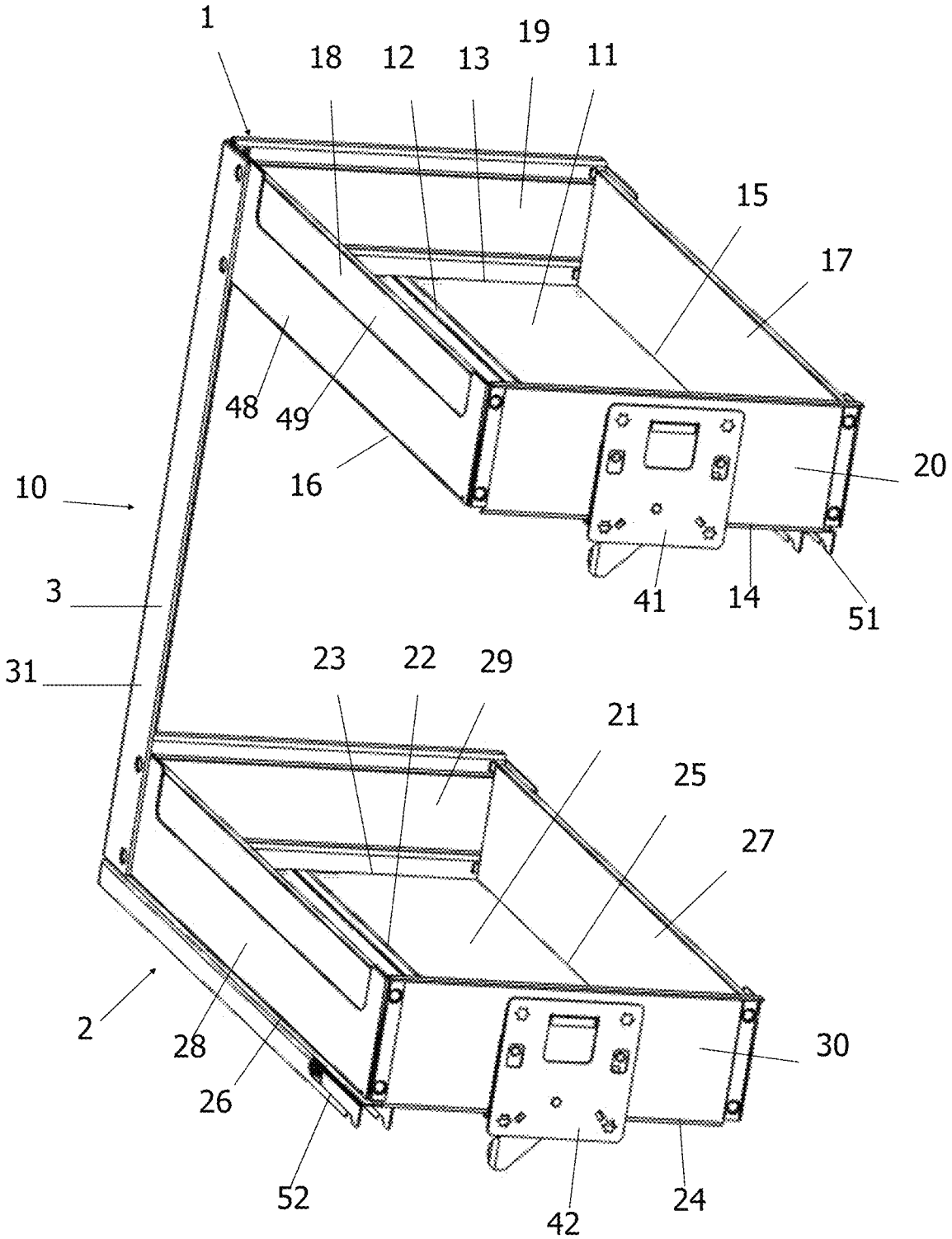

FIG. 1 shows a schematic structure of an exemplary cabinet pull-out 10 according to a first embodiment, comprising a first storage compartment 1 and a second storage compartment 2 and a pull-out frame 3. The pull-out frame 3 connects the first storage compartment 1 to the second storage compartment 2. The first and second storage compartment 1, 2 each has a first and a second base 11, 21, wherein the base is covered by the two side walls. The bases 11, 21 correspond to the bases as shown, for example, in FIG. 7. According to this exemplary embodiment, the pull-out frame 3 is provided with a carrier element 31 which extends essentially in a rectangular direction with respect to the base 11, 21 of the corresponding storage compartment. The carrier element 31 is attached to the left side wall and to the rear wall. The base of the first storage compartment 1 can, as shown in FIG. 7, be provided with a groove 12. The base of the second storage compartment 2 can, as shown in FIG. 7, be provided with a groove 22.

According to the exemplary embodiment shown in FIG. 1, each of the base 11, 21 is of a rectangular shape. In particular, each of the bases 11, 21 has a longitudinal direction and a transverse direction, the longitudinal direction corresponding to the extension direction. Each of the bases 11, 21 is provided with a rear edge 13, 23, a front edge 14, 24 and a first side edge 15, 25 connecting the rear edge 13, 23 and the front edge 14, 24, and a second side edge 16, 26 connecting the rear edge 13, 23 and the front edge 14, 24 which are visible in FIG. 7.

According to the present exemplary embodiment, the first and second storage compartments 1, 2 each are provided with a first side wall 17, 27 and a second side wall 18, 28. Each of the first side walls 17, 27 and the second side walls 18, 28 protrudes at least partially over the corresponding base 11, 21. In particular, each of the first side walls 17, 27 extends upwardly from the first side edge 15, 25. In particular, each of the second side walls 18, 28 extends upwardly from the second side edge 16, 26. The first side walls 17, 27 and the second side walls 18, 28 can extend in a vertical direction, but according to an embodiment not shown, they can also be inclined about an angle of up to 20 degrees with respect to vertical plane extending through the corresponding first or second side edge 15, 16, 25, 26. For example, each of the first side walls 17, 27 and the second side walls 18, 28 can be obtained by bending over a plate element forming the base 11, 21, for example a sheet metal element.

According to the present exemplary embodiment, the first storage compartment 1 and the second storage compartment 2 are provided with a front wall 20, 30 extending between the corresponding first side walls 17, 27 and the second side walls 18, 28. According to the present exemplary embodiment, the first storage compartment 1 and the second storage compartment 2 are provided with a rear wall 19, 29 extending between the corresponding first side walls 17, 27 and second side walls 18, 28.

A linear guide 51, 52 can be arranged between the front wall 20, 30 and the associated rear wall 19, 20 along at least one of the first side walls 17, 27 or second side walls 18, 28 adjacent to the corresponding first side edge 15, 25 or the second side edge 16, 26. The linear guides 51, 52 are not located one below the other, but on opposite side walls, according to this example, on the second side wall 18 of the first storage compartment 1 and on the first side wall 27 of the second storage compartment 2.

According to FIG. 1, a loose storage compartment 4 can be detachably coupled to the first storage compartment 1.

Figure 2:
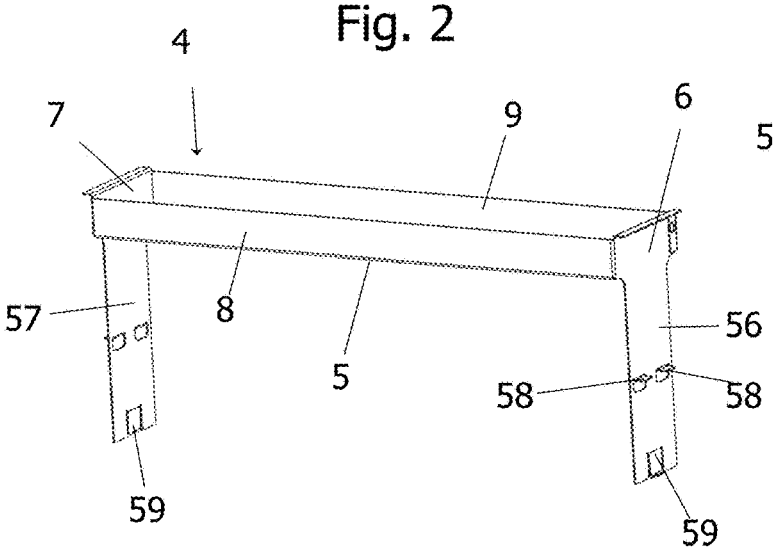

FIG. 2 shows the loose storage compartment 4 according to FIG. 1 in detail. The loose storage compartment 4 is provided with a base 5 and a front wall 6, a rear wall 7 and two side walls 8, 9 extending from the front wall and the rear wall, which laterally delimit the base 5 and protrude beyond the base 5 on its upper side. The front wall 6 and the rear wall 7 each are provided with a connecting element 56, 57 which extends below the base 5 so that it protrudes beyond the bottom of the base 5.

In the assembled state, the connecting element 56, 57 creates a distance between the base 5 of the loose storage compartment 4 and the base 11, 21 of the corresponding first or second storage compartment 1, 2, which is in the range 5 up to and including 30 cm.

In particular, the connecting element 56, 57 can be arranged adjacently to the inner side of the corresponding front wall 20, 30 and the rear wall 19, 29 in the assembled state, which is illustrated in FIG. 1.

Figure 3:
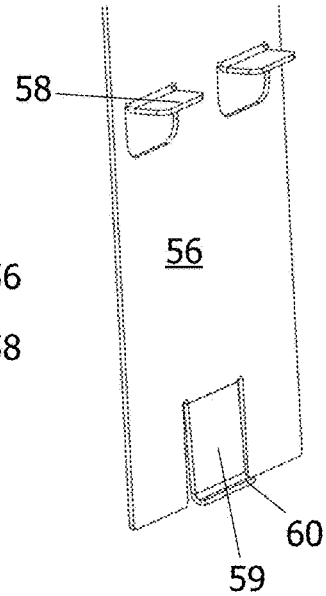

FIG. 3 shows a detail of the connecting element 56. Each of the connecting elements 56, 57 can be provided with at least one tab 58 which projects beyond the outer surface of the connecting element 56, 57 and which is configured to rest on the edge of the corresponding front wall 20, 30 and the corresponding rear wall 19, 29. In FIG. 3 two such tabs 58 are shown, which are arranged side by side in order to increase the stability of the support.

In particular, the connecting element 56, 57 is provided with a clamping element 59 which protrudes at least in sections over the outer surface of the connecting element 56, 57, so that the clamping element 59 is pressed onto the front wall 20, 30 or the rear wall 19, 29 in the assembled state.

Figure 4:
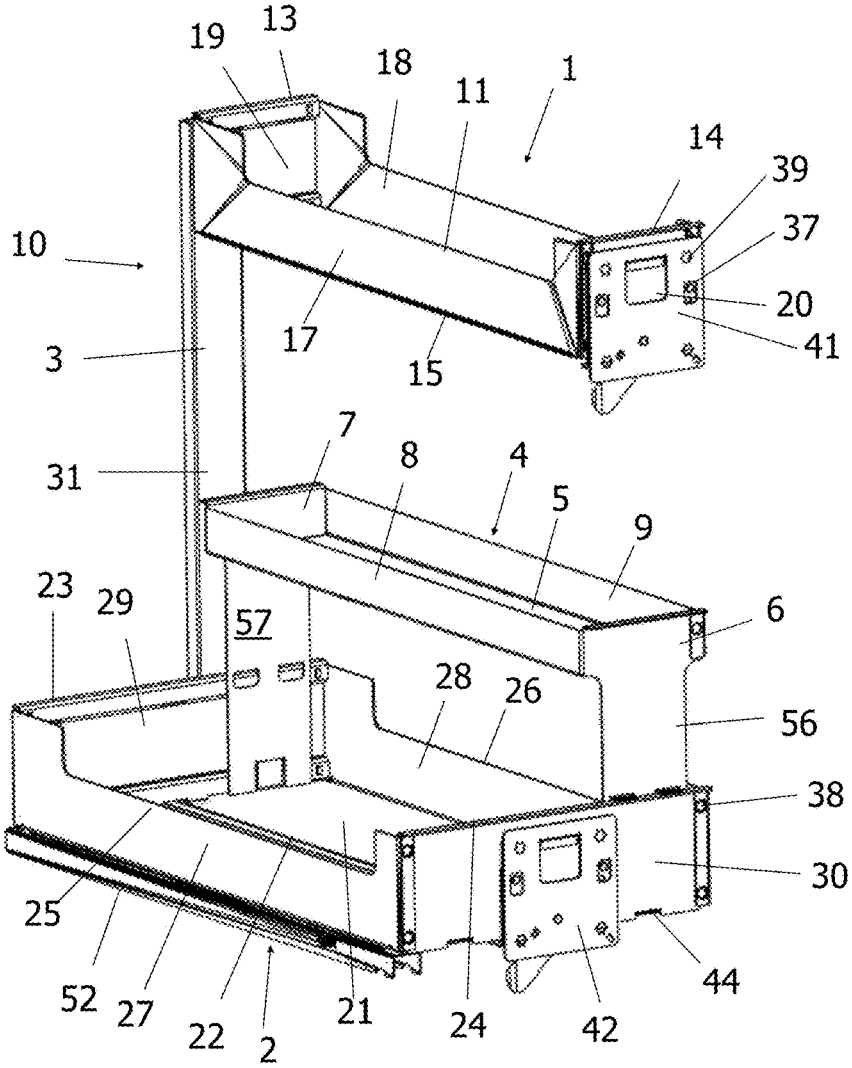

The clamping element 59 contains a hook-shaped end 60 which at least partially engages around the underside of the front wall 20, 30 or the rear wall 19, 29 in the assembled state, which is partially shown in FIG. 4.

Figure 10:
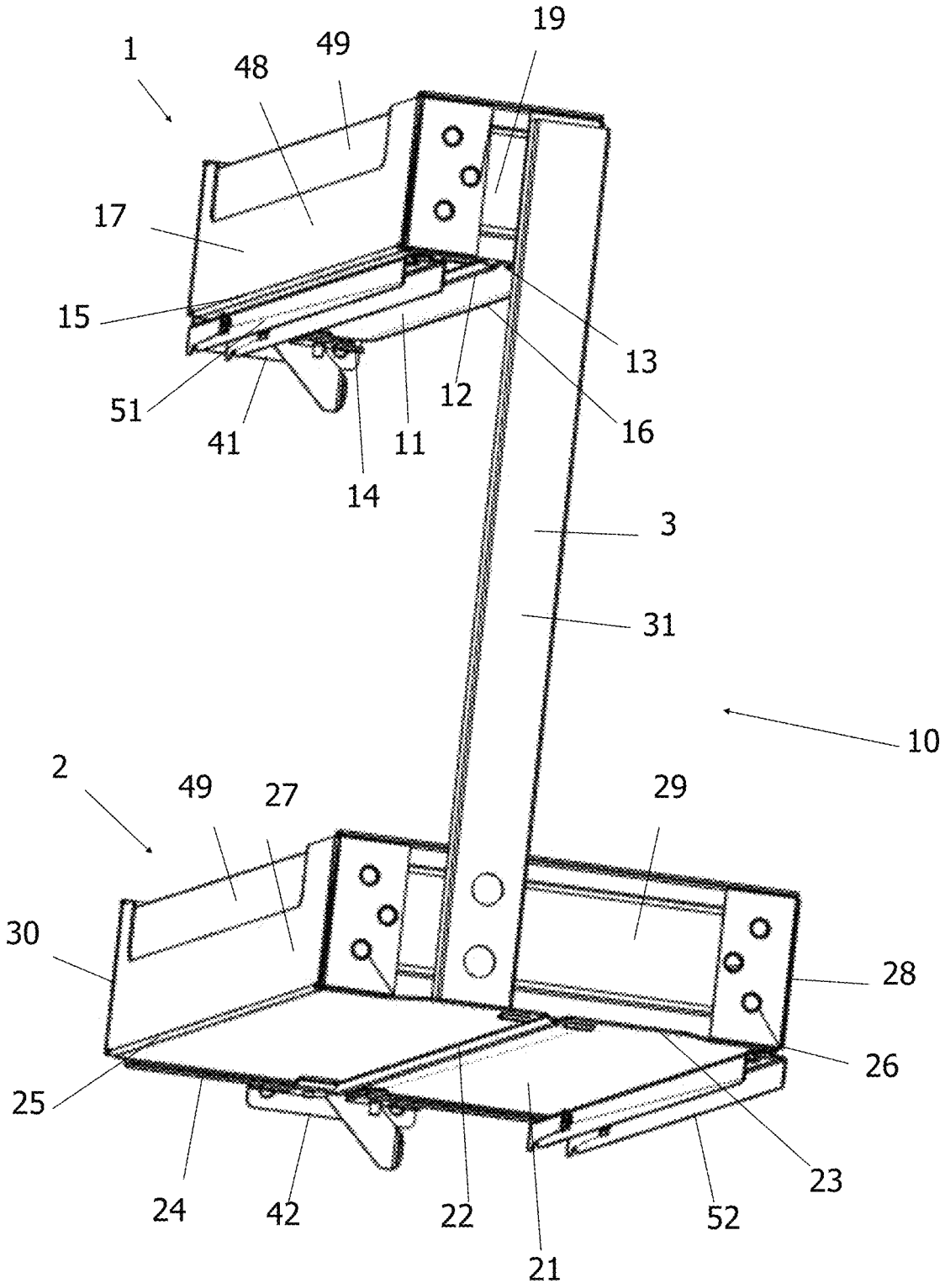

FIG. 4 shows a schematic structure of an exemplary cabinet pull-out 10 according to a second embodiment, comprising a first storage compartment 1 and a second storage compartment 2 and a pull-out frame 3. The pull-out frame 3 connects the first storage compartment 1 with the second storage compartment 2. The first and second storage compartment 1, 2 each are provided with a first and second base 11, 21, the base of the first storage compartment 2 being covered by its side walls 17, 18. The bases 11, 21 correspond to the bases as shown, for example, in FIG. 10. According to this exemplary embodiment, the pull-out frame 3 is provided with a carrier element 31 which extends essentially in a rectangular direction with respect to the base 11, 21 of the corresponding storage compartment. The carrier element 31 is attached to the rear wall 19 of the first storage compartment 1 and the rear wall 29 of the second storage compartment 2. The base of the first storage compartment 1 can, as shown in FIG. 10, be provided with a groove 12. The base of the second storage compartment 2 can, as is also shown in FIG. 10, be provided with a groove 22.

According to the embodiment shown in FIG. 4, each of the bases 11, 21 is of a rectangular shape. In particular, each of the bases 11, 21 has a longitudinal direction and a transverse direction, the longitudinal direction corresponding to the extension direction. Each of the bases 11, 21 is provided with a rear edge 13, 23, a front edge 14, 24 and a first side edge 15, 25 connecting the rear edge 13, 23 and the front edge 14, 24, and a second side edge 16, 26 connecting the rear edge 13, 23 and the front edge 14, 24 which are visible in FIG. 10.

According to the present exemplary embodiment, the first and second storage compartments 1, 2 each are provided with a first side wall 17, 27 and a second side wall 18, 28. Each of the first side walls 17, 27 and the second side walls 18, 28 protrudes at least partially over the corresponding base 11, 21. In particular, each of the first side walls 17, 27 extends upwardly from the first side edge 15, 25. In particular, each of the second side walls 18, 28 extends upwardly from the second side edge 16, 26. The first side walls 17, 27 and the second side walls 18, 28 can extend in a vertical direction, but according to an embodiment not shown, they can also be inclined about an angle of up to 20 degrees with respect to vertical plane extending through the corresponding first or second side edge 15, 16, 25, 26. For example, each of the first side walls 17, 27 and the second side walls 18, 28 can be obtained by bending over a plate element forming the base 11, 21, for example a sheet metal element.

According to the present exemplary embodiment, the first storage compartment 1 and the second storage compartment 2 are provided with a front wall 20, 30 extending between the corresponding first side walls 17, 27 and the second side walls 18, 28. According to the present exemplary embodiment, the first storage compartment 1 and the second storage compartment 2 are provided with a rear wall 19, 29 extending between the corresponding first side walls 17, 27 and second side walls 18, 28.

A linear guide 51, 52 can be arranged between the front wall 20, 30 and the associated rear wall 19, 20 along at least one of the first side walls 17, 27 or second side walls 18, 28 adjacent to the corresponding first side edge 15, 25 or the second side edge 16, 26. The linear guides 51, 52 are not located one below the other, but on opposite side walls, according to this example, on the second side wall 18 of the first storage compartment 1 and on the first side wall 27 of the second storage compartment 2, wherein only the second linear guide 52 is visible in the present illustration. The position of the first linear guide 51 can be seen in FIG. 10, for example.

According to FIG. 4, a loose storage compartment 4 can be detachably coupled to the second storage compartment 2.

The carrier element 31 according to each of the exemplary embodiments can have a rectangular cross section. In particular, the carrier element 31 is configured as a hollow profile.

The base 11, the first side wall 17 and the second side wall 18 can be formed from a flat plate element. The first and second side edges 15, 16 are configured as bending edges. The side edges 15, 16 are therefore provided with a curved shape. The depression formed by the groove 12 is also advantageously produced by a bending process, as a result of which the edges of the groove are not designed as sharp edges, but rather as rounded edges.

According to this exemplary embodiment, the front wall 20 is detachably connected to the base 11 or the side walls 15, 16. For example, a screw connection 37 can be provided in order to fasten the front wall 20 to one of the side walls 15, 16. In particular, the front wall 20 can be assembled after the base 11 and the carrier element 31 have been connected by the welded connection or screw connection. The welded connection or screw connection is much more accessible if the front wall 20 is not yet present, thus it can be advantageous to mount the front wall 20 subsequently.

Figure 5:
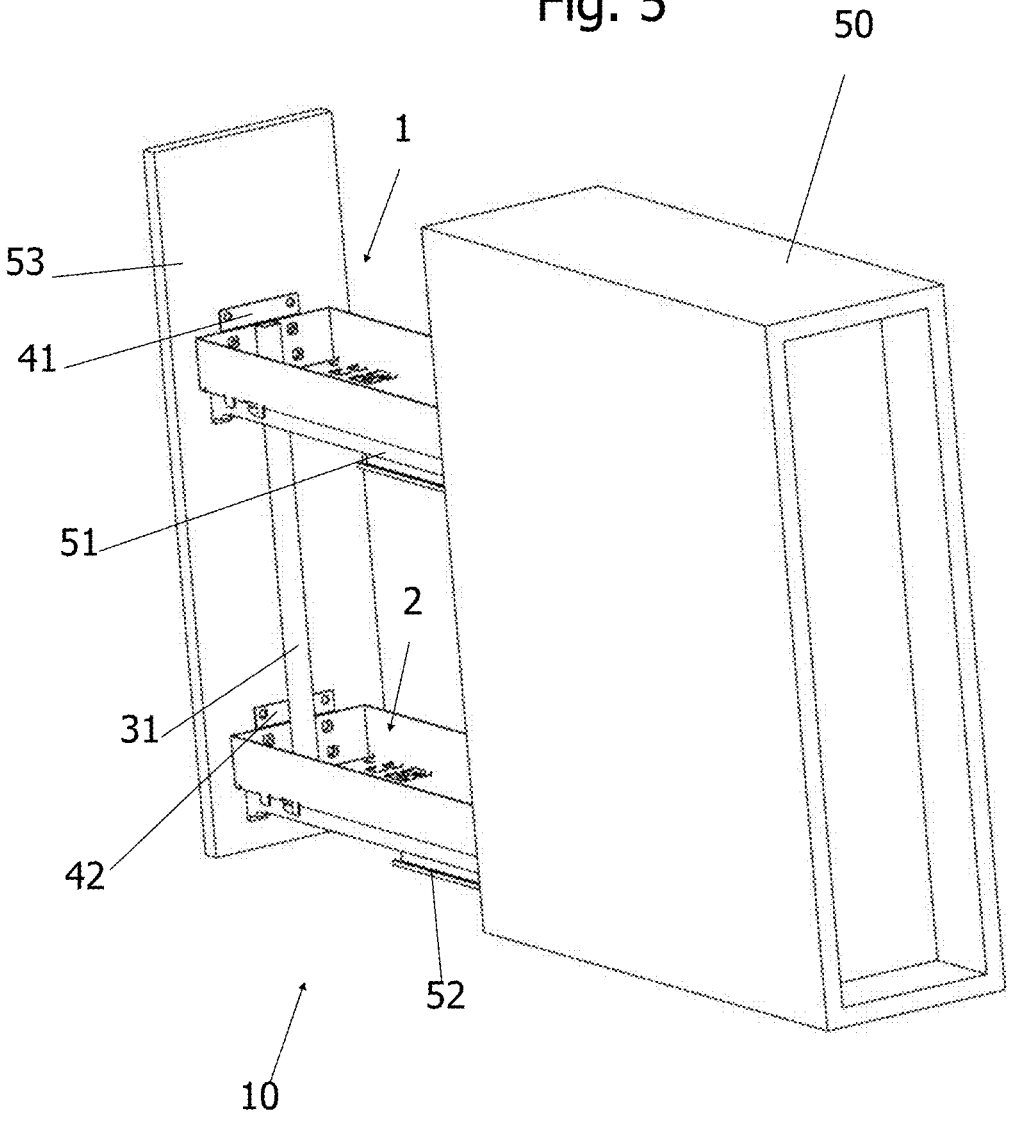

In the present exemplary embodiment, the front wall has four openings 39 which are provided for fastening a mounting plate element 41. The mounting plate element 41 is used to fasten a cover 53 which forms the front of the cabinet element for which the cabinet pull-out 10 can be used. Such a cover 53 is shown in FIG. 5.

According to this exemplary embodiment, the front edge 24 of the base 21 is provided with a recess for the support element 31 to pass through. The recess can be U-shaped. The front end of the groove 22 is located in the region of the recess.

According to this exemplary embodiment, the front wall 30 is detachably connected to the side walls 27, 28. For example, at least one screw connection 38 can be provided in in order to fasten the front wall 30 to the side walls 27, 28. In particular, the front wall 30 can be assembled after to the base 21 and the carrier element 31 have been connected by the welded connection or screw connection. The welded connection or screw connection is much more accessible if the front wall 30 is not yet present, thus it can be advantageous to mount the front wall 30 subsequently. According to the present exemplary embodiment, the front wall 30 has two tabs 44 which extend below the base 21 parallel to the latter and are partially visible in the present illustration.

The mounting plate element 42 is used to fasten a cover which forms the front of the cabinet element for which the cabinet pull-out 10 is used. Such a cover 53 is shown in FIG. 5. The fastening of the front wall 30 and the mounting plate element 42 can also take place according to this exemplary embodiment by means of a screw connection; alternatively, a plug connection can be used, which is not shown in the drawing.

FIG. 5 shows an example of a cabinet element 50 with a cabinet pull-out 10. The cabinet element 50 contains a cabinet pull-out 10, for example according to one of the preceding exemplary embodiments. A first linear guide 51 and a second linear guide 52 enable the drawer unit 10 to be displaced relative to a stationary cabinet element 50. The first and second linear guides 51, 52 can be attached to the bottom of the base 11, 21 of the storage compartment 1, 2. In particular, the carrier element 31, 32 and the first and second linear guides 51, 52 cannot be connected to one another. A stationary rail of the first or second linear guide 51, 52 can be attached to one of the side walls of the cabinet element 50. Each of the first and second linear guides 51, 52 can be provided with a rail which is movable relative to the stationary rail and which can be attached to the bottom of the base 11, 21. The movable rail can be fastened to the bottom of the base 11, 21, for example, with a screw connection or a latching connection. Optionally, a linear guide can be attached to the floor of the cabinet element 50 according to an exemplary embodiment not shown.

FIG. 5 shows a cabinet pull-out 10 according to one of the exemplary embodiments in the installed state in a cabinet element 50. The cabinet pull-out 10 is shown in a partially open state. FIG. 5 also shows a cover 53 which is attached to the mounting plate members 41, 42 (see FIG. 1 and FIG. 4). As described in the preceding exemplary embodiments, the cabinet pull-out 10 comprises a first storage compartment 1 and a second storage compartment 2, the second storage compartment 2 being arranged below the first storage compartment 1. The first storage compartment 1 and the second storage compartment 2 are connected to one another by a pull-out frame 3. Of this pull-out frame 3, only the first carrier element 31 is visible in the present illustration, which is designed as a front carrier element.

According to an embodiment, the cover 53 can be connected to each of the mounting plate elements 41, 42 without tools. For example, a plug connection or a latching connection can be provided in order to connect the cover 53 to each of the mounting plate elements 41, 42.

Figure 6:
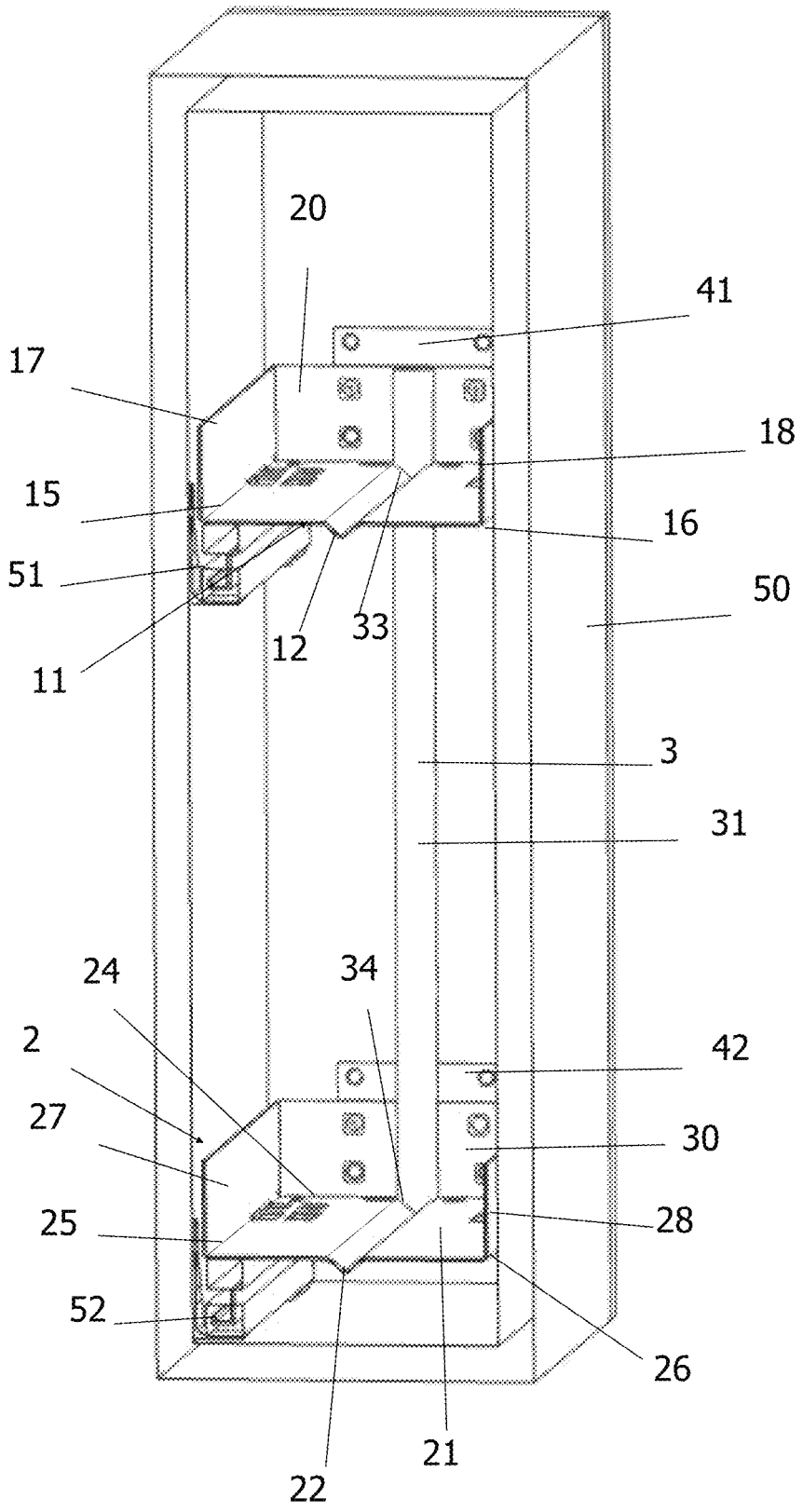

FIG. 6 shows a section through a cabinet element 50 with a cabinet pull-out 1 according to one of FIGS. 1 to 4. The rear part of the cabinet pull-out 1 is not visible because it lies in front of the cutting plane. FIG. 6 again shows the cover 53, which is attached to the mounting plate elements 41, 42 (see FIG. 1 and FIG. 4). As described in the previous exemplary embodiments, the cabinet pull-out 10 comprises a first storage compartment 1 and a second storage compartment 2, the second storage compartment 2 being arranged below the first storage compartment 1. The first storage compartment 1 and the second storage compartment 2 are connected to one another by a pull-out frame 3, only the first carrier element 31 of this pull-out frame 3 is visible in the present illustration, which is designed as a front carrier element. FIG. 6 also shows the first linear guide 51 and the second linear guide 52.

The first linear guide 51 is arranged below the base 11 of the first storage compartment 1. The first linear guide 51 comprises a movable rail which is attached to the bottom of the base 11. The movable rail is in engagement with a stationary rail that is attached to a side wall of the cabinet element 50.

The second linear guide 52 is arranged below the base 21 of the second storage compartment 2. The second linear guide 52 comprises a movable rail which is attached to the bottom of the base 21. The movable rail is in engagement with a stationary rail that is attached to a side wall of the cabinet element 50.

According to the present exemplary embodiment, the stationary rails of the first and second linear guides 51, 52 are located on the same side wall. According to an exemplary embodiment not shown, the stationary rail of one of the linear guides could be attached to the opposite side wall.

FIG. 7 shows a third embodiment for a cabinet pull-out without a loose storage compartment. FIG. 7 shows a schematic structure of an exemplary cabinet pull-out 10, comprising a first storage compartment 1 and a second storage compartment 2 and a pull-out frame 3. The pull-out frame 3 connects the first storage compartment 1 to the second storage compartment 2. The first and second storage compartment 1, 2 are provided with a first and a second base 11, 21 each. According to this exemplary embodiment, the pull-out frame 3 is provided with a carrier element 31 that extends essentially in a rectangular direction to the base 11, 21 of the corresponding storage compartment. The carrier element 31 is connected to the first storage compartment 1 and the second storage compartment 2. The base 11 of the first storage compartment 1 is provided with a groove 12. The base 21 of the second storage compartment 2 is provided with a groove 22.

According to the embodiment shown in FIG. 7, each of the bases 11, 21 is of a rectangular shape. In particular, each of the bases 11, 21 has a longitudinal direction and a transverse direction, the longitudinal direction corresponding to the extension direction. Each of the bases 11, 21 is provided with a rear edge 13, 23, a front edge 14, 24 and a first side edge 15, 25 connecting the rear edge 13, 23 and the front edge 14, 24, and a second side edge 16, 26 connecting the rear edge 13, 23 and the front edge 14, 24.

According to the present exemplary embodiment, the first and second storage compartments 1, 2 each are provided with a first side wall 17, 27 and a second side wall 18, 28. Each of the first side walls 17, 27 and the second side walls 18, 28 protrudes at least partially over the corresponding base 11, 21. In particular, each of the first side walls 17, 27 extends upwardly from the first side edge 15, 25. In particular, each of the second side walls 18, 28 extends upwardly from the second side edge 16, 26. The first side walls 17, 27 and the second side walls 18, 28 can extend in a vertical direction, but according to an embodiment not shown, they can also be inclined about an angle of up to 20 degrees with respect to vertical plane extending through the corresponding first or second side edge 15, 16, 25, 26. For example, each of the first side walls 17, 27 and the second side walls 18, 28 can be obtained by bending over a plate element forming the base 11, 21, for example a sheet metal element.

Each of the side walls 17, 27, 18, 28 can be composed of a plurality of parts. For example, each of the side walls can comprise a frame element 48 and an insert element 49. The frame element 48 and the insert element 49 are only designated for the side wall 18 in FIG. 7. Of course, each of the side walls 17, 27, 28 can have a similar structure. The insert element 49 can be plugged into the frame element 48. The insert element 49 can have a different color than the frame element 48; it can also consist of a different material. For example, the frame element 48 can contain a metal, the insert element 49 can contain wood or a plastic.

According to the present exemplary embodiment, the first storage compartment 1 and the second storage compartment 2 are provided with a front wall 20, 30 extending between the corresponding first side walls 17, 27 and second side walls 18, 28.

According to the present exemplary embodiment, the first storage compartment 1 and the second storage compartment 2 are provided with a rear wall 19, 29 extending between the corresponding first side walls 17, 27 and second side walls 18, 28.

A linear guide 51, 52 can be arranged between the front wall 20, 30 and the associated rear wall 19, 20 along at least one of the first side walls 17, 27 or second side walls 18, 28 adjacent to the corresponding first side edge 15, 25 or the second side edge 16, 26. In contrast to the exemplary embodiment shown in FIG. 5, the linear guides 51, 52 are not located one below the other, but on opposite side walls, here, for example, on the first side wall 17 of the first storage compartment 1 and on the second side wall 28 of the second storage compartment 2.

According to this exemplary embodiment, too, only a single linear guide can be provided per storage compartment. The stability of the cabinet pull-out is increased by the pull-out frame and each one of the linear guides 51, 52 per storage compartment which corresponds to the stability of conventional drawers. However, compared with conventional drawers, one linear guide per storage compartment can be dispensed with. Surprisingly, it has been shown that the stability is comparable.

In addition, the arrangement according to the present embodiment has the further advantage that the front wall and the rear wall can serve as a base element for further storage compartments, which can be plugged onto at least one of the front walls and the rear walls or attached to one of the side walls, for example by means of a plug connection.

Each of the two front walls 20, 30 of the first and second storage compartment 1, 2 can be provided with a mounting plate element 41, 42. The mounting plate element 41, 42 is used to fasten a cover 53 which forms the front of the cabinet element for which the cabinet pull-out 10 can be used. Such a cover 53 is shown exemplarily in FIG. 5.

According to the present exemplary embodiment, the groove 12, 22 extends in the longitudinal direction. In particular, the base 11, 21 has a longitudinal central axis which extends in the longitudinal direction. According to the present exemplary embodiment, the groove 12, 22 is symmetrical with respect to the longitudinal central axis. In particular, the groove 12, 22 can be V-shaped. According to an exemplary embodiment not shown in the drawing, the groove 12, 22 can be U-shaped. The groove 12, 22 projects beyond the bottom of the base 11, 21. According to the present embodiment, the groove 12, 22 extends from the rear edge 13, 23 to the front edge 14, 24 of the bases 11, 21. According to the present embodiment, the groove 12, 22 is not connected to the carrier element 31.

Figure 8:
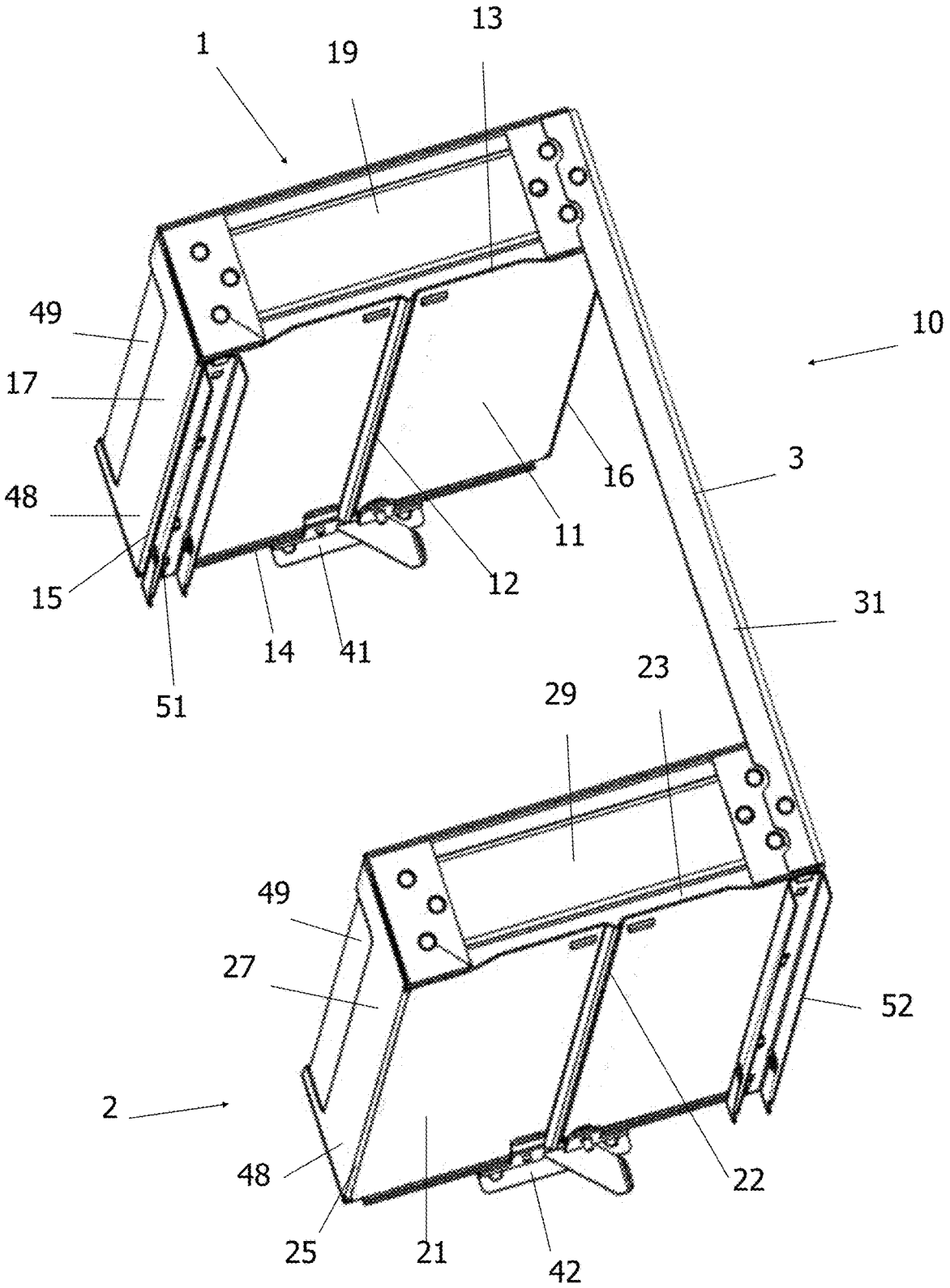

FIG. 8 shows a rear view of the cabinet pull-out according to FIG. 7, that is to say in a view of the first and second rear walls 19, 29 of the first and second storage compartments 1, 2. The direction of view is selected from below, so that the first base 11 and the second base 21 are visible. Each of the bases 11, 21 contains a groove 12, 22, which extends in the pull-out direction, i.e., parallel to the first and second linear guides 51, 52. According to the present embodiment, the groove 12, 22 formed on the top of the base 11, 21 is configured as a rib on the bottom of the base 11, 21.

According to the present exemplary embodiment, each of the first and second storage compartments 1, 2 is provided with a linear guide 51, 52. Only the movable rail of the first and second linear guides 51, 52 is shown.

Figure 9:
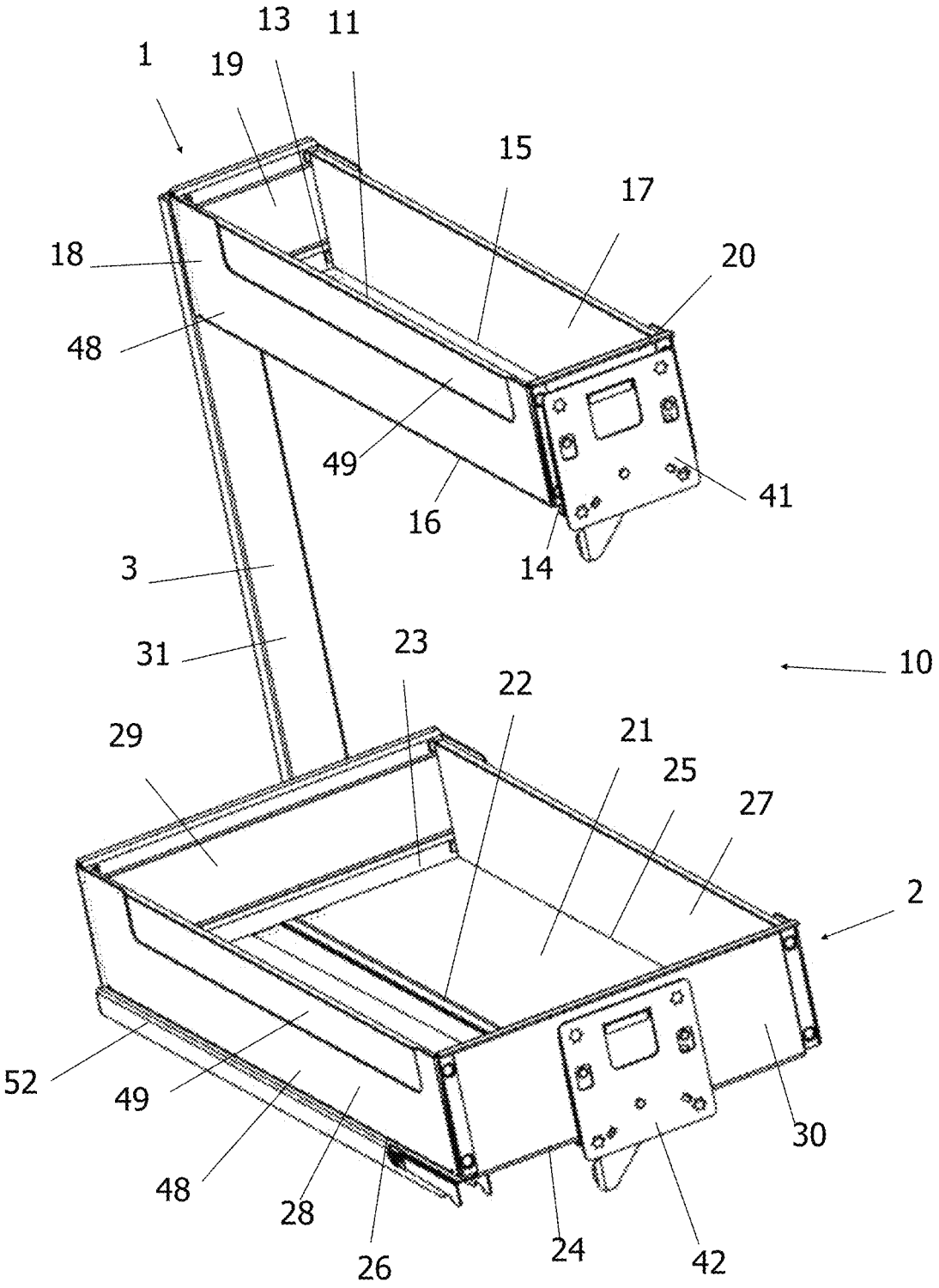

FIG. 9 shows an exemplary embodiment for a cabinet pull-out according to FIG. 4 without a loose storage compartment. FIG. 9 shows a schematic structure of an exemplary cabinet pull-out 10, comprising a first storage compartment 1 and a second storage compartment 2 and a pull-out frame 3. The pull-out frame 3 connects the first storage compartment 1 with the second storage compartment 2. The first and second storage compartments 1, 2 are each provided with a first and a second base 11, 21. According to this exemplary embodiment, the pull-out frame 3 is provided with a carrier element 31 that extends essentially in a rectangular direction with respect to the base 11, 21 of the corresponding storage compartment. The carrier element 31 is connected to the first storage compartment 1 and the second storage compartment 2. The base 11 of the first storage compartment 1 is provided with a groove 12. The base 21 of the second storage compartment 2 is provided with a groove 22.

According to the embodiment shown in FIG. 9, each of the bases 11, 21 are of a rectangular shape. In particular, each of the bases 11, 21 has a longitudinal direction and a transverse direction, the longitudinal direction corresponding to the extension direction. Each of the bases 11, 21 is provided with a rear edge 13, 23, a front edge 14, 24 and a first side edge 15, 25 connecting the rear edge 13, 23 and the front edge 14, 24, and a second side edge 16, 26 connecting the rear edge 13, 23 and the front edge 14, 24.

According to the present exemplary embodiment, the first and second storage compartments 1, 2 each are provided with a first side wall 17, 27 and a second side wall 18, 28. Each of the first side walls 17, 27 and the second side walls 18, 28 protrudes at least partially over the corresponding base 11, 21. In particular, each of the first side walls 17, 27 extends upwardly from the first side edge 15, 25. In particular, each of the second side walls 18, 28 extends upwardly from the second side edge 16, 26. The first side walls 17, 27 and the second side walls 18, 28 can extend in a vertical direction, but according to an embodiment not shown, they can also be inclined about an angle of up to 20 degrees with respect to vertical plane extending through the corresponding first or second side edge 15, 16, 25, 26. For example, each of the first side walls 17, 27 and the second side walls 18, 28 can be obtained by bending over a plate element forming the base 11, 21, for example a sheet metal element.

Each of the side walls 17, 27, 18, 28 can be composed of a plurality of parts. For example, each of the side walls can comprise a frame element 48 and an insert element 49. The frame element 48 and the insert element 49 are only designated for the side wall 18 in FIG. 9. Of course, each of the side walls 17, 27, 28 can have a similar structure. The insert element 49 can be plugged into the frame element 48. The insert element 49 can have a different color than the frame element 48; it can also consist of a different material. For example, the frame element 48 can contain a metal, the insert element 49 can contain wood or a plastic.

According to the present exemplary embodiment, the first storage compartment 1 and the second storage compartment 2 are provided with a front wall 20, 30 extending between the corresponding first side walls 17, 27 and second side walls 18, 28.

According to the present exemplary embodiment, the first storage compartment 1 and the second storage compartment 2 are provided with a rear wall 19, 29 extending between the corresponding first side walls 17, 27 and second side walls 18, 28.

A linear guide 51, 52 can be arranged between the front wall 20, 30 and the associated rear wall 19, 20 along at least one of the first side walls 17, 27 or second side walls 18, 28 adjacent to the corresponding first side edge 15, 25 or the second side edge 16, 26. In contrast to the exemplary embodiment shown in FIG. 5, the linear guides 51, 52 are not located one below the other, but on opposite side walls, here, for example, on the first side wall 17 of the first storage compartment 1 and on the second side wall 28 of the second storage compartment 2.

According to this exemplary embodiment, too, only a single linear guide can be provided per storage compartment. The stability of the cabinet pull-out is increased by the pull-out frame and each one of the linear guides 51, 52 per storage compartment which corresponds to the stability of conventional drawers. However, compared with conventional drawers, one linear guide per storage compartment can be dispensed with. Surprisingly, it has been shown that the stability is comparable.

In addition, the arrangement according to the present embodiment has the further advantage that the front wall and the rear wall can serve as a base element for further storage compartments, which can be plugged onto at least one of the front walls and the rear walls or attached to the upper storage compartment.

Each of the two front walls 20, 30 of the first and second storage compartment 1, 2 can be provided with a mounting plate element 41, 42. The mounting plate element 41, 42 is used to fasten a cover 53 which forms the front of the cabinet element for which the cabinet pull-out 10 can be used. Such a cover 53 is shown exemplarily in FIG. 5.

According to the present exemplary embodiment, the groove 12, 22 extends in the longitudinal direction. In particular, the base 11, 21 has a longitudinal central axis which extends in the longitudinal direction. According to the present exemplary embodiment, the groove 12, 22 is symmetrical with respect to the longitudinal central axis. In particular, the groove 12, 22 can be V-shaped. According to an exemplary embodiment not shown in the drawing, the groove 12, 22 can be U-shaped. The groove 12, 22 projects beyond the bottom of the base 11, 21. According to the present embodiment, the groove 12, 22 extends from the rear edge 13, 23 to the front edge 14, 24 of the respective bases 11, 21. According to the present embodiment, the groove 12, 22 is not connected to the carrier element 31.

FIG. 10 shows a rear view of the cabinet pull-out according to FIG. 9. According to the present exemplary embodiment, the carrier element 31 is arranged on the outside of the first and second rear walls 19, 29. The carrier element 31 can in particular be arranged in the vicinity of one of the corners of the first or second rear walls 19, 29, in particular directly adjacent to the corner of at least one of the rear walls 19, 29.

According to the embodiment shown in FIG. 9 and FIG. 10, the first base 11 of the first storage compartment 1 is smaller than the second base 21 of the second storage compartment 2. According to this embodiment, objects of a height greater than the distance between the first storage compartment 1 and the second storage compartment 2 can be stored in the second storage compartment 2.

It is obvious to a person skilled in the art that many further variants are possible in addition to the exemplary embodiments described without deviating from the inventive concept. The subject matter of the invention is therefore not restricted by the preceding description and is determined by the scope of protection which is defined by the claims. The broadest possible reading of the claims is authoritative for the interpretation of the claims or the description. In particular, the terms "contain" or "include" are to be interpreted in such a way that they refer to elements, components, or steps in a non-exclusive sense, which is intended to indicate that the elements, components, or steps can be present or are used that they can be combined with other elements, components or steps that are not explicitly mentioned. When the claims relate to an element or component from a group which may consist of A, B, C to N elements or components, this formulation is to be interpreted in such a way that only a single element of that group is required, and not necessarily any combination of A and N, B and N, or any other combination of two or more elements or components of this group.

What is claimed is:

1. A cabinet pull-out comprising a first storage compartment and a second storage compartment and a pull-out frame, the pull-out frame connecting the first storage compartment to the second storage compartment, wherein the first and second storage compartments each are provided with a base, the pull-out frame being provided with a carrier element arranged substantially rectangularly to the base of the corresponding storage compartment, wherein the carrier element extends from the first storage compartment to the second storage compartment, wherein each of the first and second storage compartments is provided with a front wall and a rear wall and two side walls, wherein each of the side walls extends between the front wall and the rear wall, wherein the carrier element is attached to an external side of the rear wall or to one of the side walls, wherein a loose storage compartment is detachably coupled to one of the first or second storage compartments, wherein the loose storage compartment is provided with a base and a front wall, a rear wall and two side walls extending from the front wall and the rear wall, which laterally delimit the base and protrude beyond the base on its upper side, wherein the front wall and the rear wall each are provided with a connecting element which extends below the base and protrudes beyond a bottom of the base, wherein each of the connecting elements is provided with at least one tab projecting beyond an outer surface of the connecting element and wherein the at least one tab is configured to rest on an edge of the front wall or the rear wall.

2. The cabinet pull-out of claim 1, wherein each of the connecting elements in an assembled state establishes a distance between the base of the loose storage compartment and the base of one of the first or second storage compartments which is in a range of 5 cm up to and including 30 cm.

3. The cabinet pull-out of claim 1, wherein each of the connecting elements in an assembled state is arranged adjacently to an inside of one of the front wall or the rear wall.

4. The cabinet pull-out of claim 1, wherein the connecting element is provided with a clamping element which projects at least partially beyond an outer surface of the connecting element so that the clamping element is pressed onto the front wall or the rear wall in an assembled state.

5. The cabinet pull-out of claim 4, wherein the clamping element contains a hook-shaped end which at least partially engages around an underside of the front wall or the rear wall in the assembled state.

6. The cabinet pull-out of claim 1, wherein the first and second storage compartments are connected to one another by a single carrier element.

7. The cabinet pull-out of claim 1, wherein at least one of the bases of the first or second storage compartment is provided with a groove.

8. The cabinet pull-out of claim 7, wherein the base is provided with a rear edge, a front edge and a first side edge connecting the front edge and the rear edge and a second side edge connecting the front edge and the rear edge, wherein the groove extends from the front edge to the rear edge, wherein a recess is formed between the front edge and the rear edge in a region of the groove.

9. The cabinet pull-out of claim 1, wherein the base has a longitudinal direction and a transverse direction, wherein the longitudinal direction corresponds to a pull-out direction, wherein a groove extends in the longitudinal direction.

10. The cabinet pull-out of claim 9, wherein the base has a longitudinal central axis which extends in the longitudinal direction, wherein the groove is arranged symmetrically with respect to the longitudinal central axis.

11. A loose storage compartment for a cabinet pull-out, wherein the loose storage compartment is provided with a base and a front wall, a rear wall and two side walls extending from the front wall and the rear wall, which laterally delimit the base and project beyond the base, wherein the front wall and the rear wall are provided each with a connecting element which extends below the base and protrudes beyond a bottom of the base, wherein the loose storage compartment is provided with a base and a front wall, a rear wall and two side walls extending from the front wall and the rear wall, which laterally delimit the base and protrude beyond the base on its upper side, wherein the front wall and the rear wall each are provided with a connecting element which extends below the base and protrudes beyond a bottom of the base, wherein each of the connecting elements is provided with at least one tab projecting beyond an outer surface of the connecting element and wherein the at least one tab is configured to rest on an edge of the front wall or the rear wall.

12. The loose storage compartment of claim 11, wherein the connecting element is provided with a clamping element which protrudes beyond an outer surface of the connecting element at least partially.

13. The loose storage compartment of claim 12, wherein the clamping element encloses with the connecting element an angle of up to and including 10 degrees.

* * * * *